US011506474B1

(12) United States Patent
Goss et al.

(10) Patent No.: US 11,506,474 B1
(45) Date of Patent: Nov. 22, 2022

(54) SPIN-STABILIZED FUZE ASSEMBLY

(71) Applicant: AURA Technologies, LLC, Raleigh, NC (US)

(72) Inventors: Garrett Goss, Cary, NC (US); Alex Blate, Raleigh, NC (US)

(73) Assignee: AURA Technologies, LLC, Carrboro, NC (US)

( * ) Notice: Subject to any disclaimer, the term of this patent is extended or adjusted under 35 U.S.C. 154(b) by 0 days.

(21) Appl. No.: 17/832,012

(22) Filed: Jun. 3, 2022

Related U.S. Application Data

(60) Provisional application No. 63/196,358, filed on Jun. 3, 2021.

(51) Int. Cl.
*F42C 15/26* (2006.01)
*F42C 1/04* (2006.01)

(52) U.S. Cl.
CPC ..... *F42C 15/26* (2013.01); *F42C 1/04* (2013.01)

(58) Field of Classification Search
CPC ..... F42C 1/02; F42C 1/00; F42C 1/04; F42C 15/26
USPC ..... 102/204
See application file for complete search history.

(56) References Cited

U.S. PATENT DOCUMENTS

| | | | | |
|---|---|---|---|---|
| 2,900,908 | A | 8/1959 | Burrell | |
| 3,076,410 | A | 2/1963 | Guerne | |
| 3,264,995 | A * | 8/1966 | Libby | F42C 1/06 102/245 |
| 3,580,176 | A * | 5/1971 | Boswell | F42C 14/00 73/514.01 |
| 3,937,146 | A | 2/1976 | Davis et al. | |
| 4,800,814 | A | 1/1989 | Holt et al. | |
| 5,056,434 | A | 10/1991 | Patel et al. | |
| 5,216,196 | A | 6/1993 | Anderson | |
| 6,035,783 | A * | 3/2000 | Cho | F42C 1/02 102/273 |
| 8,104,405 | B2 | 1/2012 | Lafont et al. | |
| 8,151,708 | B2 | 4/2012 | Ritchie | |
| 2010/0258021 | A1 * | 10/2010 | Lafont | F42C 1/04 102/222 |

* cited by examiner

*Primary Examiner* — John Cooper
(74) *Attorney, Agent, or Firm* — Danielson Legal LLC

(57) ABSTRACT

Fuze assembly methods and devices. The methods include providing a firing pin to detonate the projectile; operably connecting a weighted body to the firing pin; and operably connecting a flexural portion to the weighted body to retain position of the weighted body due to centrifugal force generated by the rotation of the projectile to retain the firing pin in a detonation prevention position and move the weighted body to drive the firing pin to a detonation position upon impact of the projectile.

22 Claims, 6 Drawing Sheets

SPIN-STABILIZED FUZE ASSEMBLY

CROSS REFERENCE TO RELATED APPLICATIONS

The present application claims the benefit of and priority to U.S. provisional application No. 63/196,358, filed on Jun. 3, 2021, the content of which is hereby incorporated by reference as if set forth in its entirety herein.

STATEMENT REGARDING FEDERALLY SPONSORED RESEARCH OR DEVELOPMENT

This invention was made with Government support under contract W15QKN-19-C-0005 awarded by the United States Army. The government may have certain rights in the invention.

TECHNICAL FIELD

Embodiments described herein generally relate to projectile devices and methods and, more particularly but not exclusively, to projectile fuzing devices and methods.

BACKGROUND

Projectiles such as munitions often rely on spin stabilization to improve performance. When fired, the projectile is accelerated axially downrange and is forced to rotate about the same axis. The weapon barrel causes this rotation, which improves the terminal ballistics of the projectile.

Munitions should detonate on impact with or in proximity to the intended target. Munitions must also not detonate prematurely, such as during transport, handling, or firing. Munitions are therefore constructed with arming and fuzing mechanisms to achieve safety up-range and reliable detonation downrange.

A wide range of arming and fuzing mechanisms have been used for centuries. However, existing mechanisms are complex and involve many precision-designed and manufactured components. The complexity of these mechanisms makes them expensive to produce, and may require specialized tooling and manufacturing techniques.

A need exists, therefore, for devices and methods that overcome the disadvantages of existing arming and fuzing mechanisms.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

According to one aspect, embodiments relate to a fuze assembly. The fuze assembly includes a firing pin configured to detonate a projectile; a weighted body in operable connectivity with the firing pin; and a flexural portion in operable connectivity with the weighted body configured to control positioning of the weighted body due to centrifugal force generated by rotation of the projectile such that the firing pin is in a detonation prevention position and control the movement of the weighted body to drive the firing pin to a detonation position upon impact of the projectile.

In some embodiments, wherein two or more of the baseplate, the weighted body, and the flexural portion are formed as a single component.

In some embodiments, the projectile assembly includes a plurality of weighted bodies and a plurality of flexural portions, wherein each of the plurality of flexural portions are operably connected with a weighted body of the plurality of weighted bodies.

In some embodiments, the projectile assembly includes a baseplate connected to the flexural portion and includes a bore for directing the firing pin to the detonation position. In some embodiments, the baseplate is configured to receive a first weighted body of a first size and weight, enable an operator to remove the first weighted body, and receive a second weighted body of a second size and weight. In some embodiments, the bore is non-cylindrical and includes a ribbed component to minimize contact with the firing pin.

In some embodiments, the firing pin includes an annular groove configured to receive the weighted body.

In some embodiments, the weighted body includes a deflection prevention feature to prevent excess deflection.

In some embodiments, a center of mass of the weighted body is offset from an axis of rotation of the projectile.

In some embodiments, the projectile assembly includes an actuator ring portion positioned to, upon impact of the projectile, apply a force to the weighted body to drive the firing pin to the detonation position.

According to another aspect, embodiments relate to a method for assembling a fuze for a projectile. The method includes providing a firing pin to detonate the projectile; operably connecting a weighted body to the firing pin; and operably connecting a flexural portion to the weighted body to control the position of the weighted body due to centrifugal force generated by rotation of the projectile such that the firing pin is in a detonation prevention position, and control the movement of the weighted body to drive the firing pin to a detonation position upon impact of the projectile.

In some embodiments, two or more of the baseplate, the weighted body, and the flexural portion are formed as a single component.

In some embodiments, the method further includes operably connecting a plurality of flexural portions to each of a plurality of weighted bodies.

In some embodiments, the method further includes connecting a baseplate to the flexural portion, wherein the baseplate includes a bore for directing the firing pin to the detonation position. In some embodiments, the baseplate is configured to receive a first weighted body of a first size and weight, enable an operator to remove the first weighted body, and receive a second weighted body of a second size and weight. In some embodiments, the bore is non-cylindrical and includes a ribbed component to minimize contact with the firing pin.

In some embodiments, the method further includes providing the firing pin with an annular groove to receive the weighted body.

In some embodiments, the method further includes configuring the weighted body with a deflection prevention feature to prevent excess deflection.

In some embodiments, a center of mass of the weighted body is offset from an axis of rotation of the projectile.

In some embodiments, the method further includes positioning an actuator ring portion to, upon impact of the projectile, apply a force to the weighted body to drive the firing pin to the detonation position.

BRIEF DESCRIPTION OF DRAWINGS

Non-limiting and non-exhaustive embodiments of the invention are described with reference to the following figures, wherein like reference numerals refer to like parts throughout the various views unless otherwise specified.

DETAILED DESCRIPTION

Figure 1:
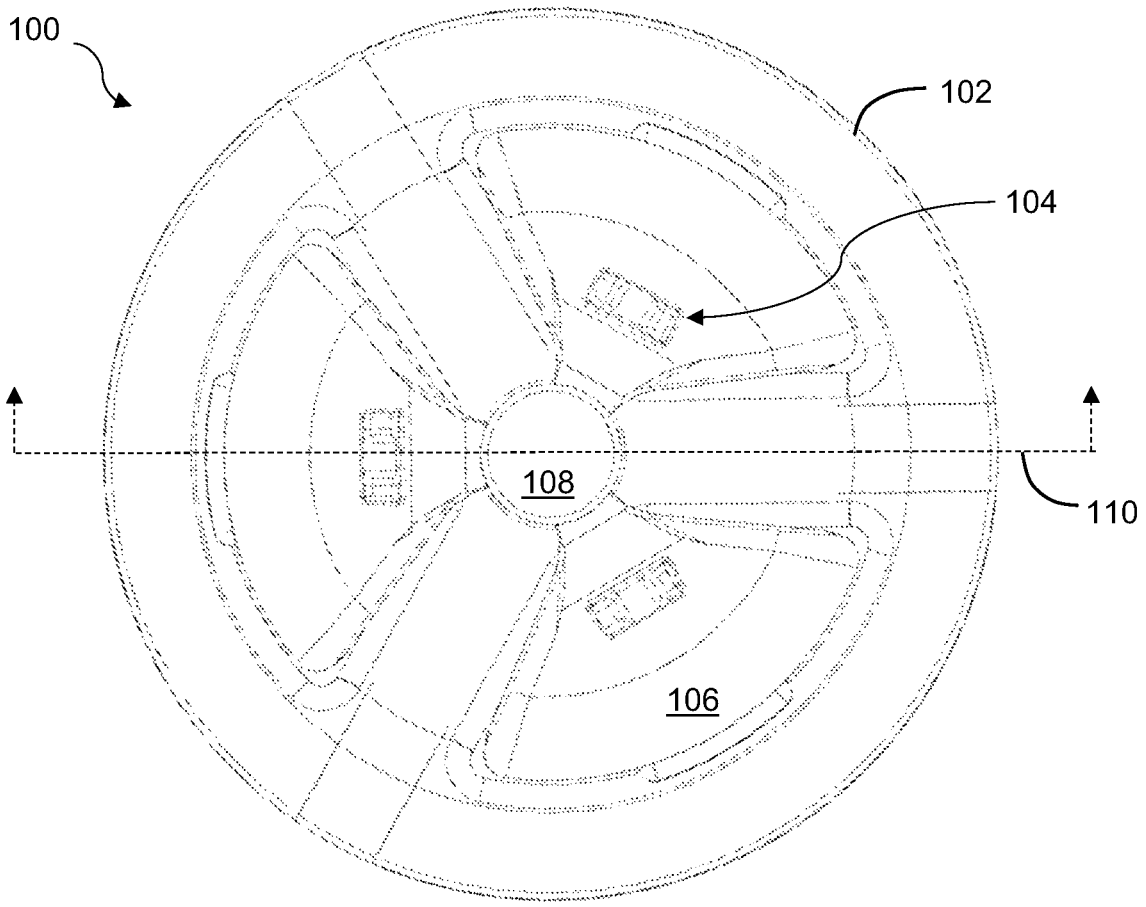
FIG. 1 illustrates a top view of a fuze assembly in accordance with one embodiment.

Various embodiments are described more fully below with reference to the accompanying drawings, which form a part hereof, and which show specific exemplary embodiments. However, the concepts of the present disclosure may be implemented in many different forms and should not be construed as limited to the embodiments set forth herein; rather, these embodiments are provided as part of a thorough and complete disclosure, to fully convey the scope of the concepts, techniques and implementations of the present disclosure to those skilled in the art. Embodiments may be practiced as methods, systems or devices. Accordingly, embodiments may take the form of a hardware implementation, an entirely software implementation or an implementation combining software and hardware aspects. The following detailed description is, therefore, not to be taken in a limiting sense.

Reference in the specification to "one embodiment" or to "an embodiment" means that a particular feature, structure, or characteristic described in connection with the embodiments is included in at least one example implementation or technique in accordance with the present disclosure. The appearances of the phrase "in one embodiment" in various places in the specification are not necessarily all referring to the same embodiment. The appearances of the phrase "in some embodiments" in various places in the specification are not necessarily all referring to the same embodiments.

In addition, the language used in the specification has been principally selected for readability and instructional purposes and may not have been selected to delineate or circumscribe the disclosed subject matter. Accordingly, the present disclosure is intended to be illustrative, and not limiting, of the scope of the concepts discussed herein.

As discussed previously, existing arming and fuzing mechanisms (for simplicity, "fuzing mechanisms") are complex and require several precisely-designed and manufactured components. The complexity of such mechanisms and the required precision makes them expensive to produce. Manufacturing such mechanisms often requires a large number of specialized, dedicated machines and tools; this makes it expensive and difficult to scale production of such mechanisms and can lead to supply chain and logistical risks.

Additionally, fuzing mechanisms with a high number of components have more potential points of failure. These existing fuzing mechanisms therefore risk failing to detonate when desired and detonating when not desired.

Some existing fuzing mechanisms are powered largely by electrical or electromechanical means. These types of fuzing mechanisms are therefore susceptible to electromagnetic interferences, pulses, or other phenomena that may affect their performance. Additionally, these types of fuzing mechanisms require batteries or other sources of electrical power that are sensitive to extreme temperatures or other environmental conditions. Additionally, these batteries or power sources may be difficult to source, particularly if domestic production is required.

In mechanical-based fuzing mechanisms, a detonator may comprise a small amount of a primary or sensitive explosive, and may be triggered by mechanical means such as by impact of a firing pin or by electrical means such as a bridge-wire or electronic match. Regardless of the type of trigger, a shockwave from the detonation of the primary explosive triggers the detonation of a high-explosive charge or another insensitive, secondary explosive.

It is important that the firing pin or equivalent impacts the detonator with sufficient force to trigger the detonator. Similarly, it is important to prevent the firing pin from interacting with the detonator prior to firing such as during transport or handling, during firing, or otherwise before detonation is desired. Likewise, it is important that electrically- or electromechanically-triggered detonators not be energized prior to firing, such as during transport of handling, during firing, or otherwise before detonation is desired. One of ordinary skill in the art will recognize that a firing pin or functionally equivalent element can be used to trigger electronic or electromechanical fuzing or firing systems by, e.g., actuating a switch, conductively completing a circuit, or interacting with an optical sensor.

Embodiments herein provide novel fuzing assemblies and methods. The described fuze assemblies may be used in conjunction with a variety of munitions to achieve reliable detonation capabilities. One of average skill in the art will recognize that the fuze assembly of the present invention may be used in conjunction with other fuzing or arming components of a firing chain, such as time- or rotational-delay fuzes or arming devices, electronic or electromechanical fuzing, arming, or targeting devices, proximity-sensing devices, etc. and that, specifically, in some embodiments or applications, detonation of the projectile may be triggered or controlled by multiple fuzing and/or arming mechanisms, individually or severally, inclusive of or, in some cases, exclusive of the present invention.

The fuze assemblies herein are more reliable than existing mechanisms, include smaller part counts, and can be manufactured with and are manufactured with looser tolerances. As such, the fuze assemblies herein (1) cost less to manufacture than existing devices, (2) can be fabricated using more readily-accessible materials and methods than existing devices, and (3) use fewer components than existing devices.

The fuze assemblies herein include a baseplate with a central bore and one or more flexural portions extending therefrom. Each of the one or more flexural portions may be configured with one or more weighted portions. The weighted portion(s) pivot outward from the center bore when being subject to centrifugal force caused by a rotational velocity above a threshold. This outward movement directs a firing pin away from a detonator. At impact, one or more weighted portions move inward to drive the firing pin through the central bore and into the detonator. In some embodiments, the weighted portions are arranged radially with respect to the central bore such that at least one weighted portion will be driven inward on impact at oblique angles.

As discussed above, the embodiments herein also offer improvements over existing mechanisms by using significantly less precise manufacturing processes. For example, the components of the embodiments herein may be manufactured through additive manufacturing, which is not possible for existing techniques due to the required manufacturing tolerances.

Specifically, existing mechanisms specify manufacturing tolerances as small as ±0.0003 inches (about 8 microns). Embodiments described herein, on the other hand, are robust to manufacturing tolerances of at least ±0.001 inches (25.4 microns). Accordingly, the fuze assemblies herein may be cheaper to manufacture than existing mechanisms, as the fewer components that are required have larger manufacturing tolerances than components of existing mechanisms.

One of ordinary skill in the art will recognize that out-of-tolerance parts may lead to malfunctions including premature arming, failure to arm, premature detonation, or failure to detonate on impact. One of ordinary skill in the art will recognize that parts with looser tolerances are typically cheaper, easier, and faster to produce and inspect.

FIG. 1 illustrates a top view of a fuze assembly 100 in accordance with one embodiment. The projectile assembly 100 may be inserted into or otherwise used in conjunction with a variety of projectile or munition types, and possibly in conjunction with other firing chain components.

Figure 2:
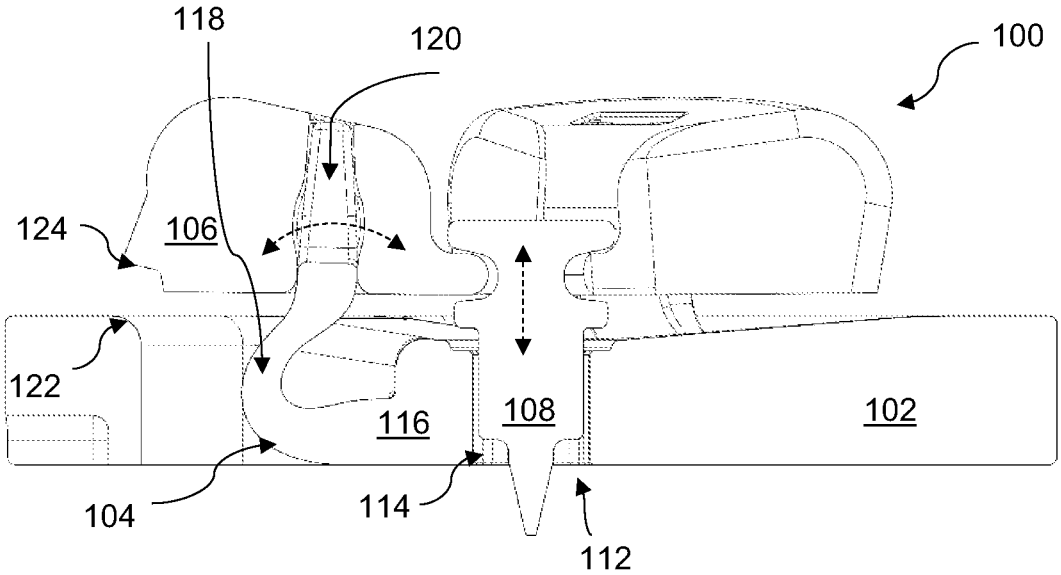
FIG. 2 illustrates a cross-sectional view of the fuze assembly of FIG. 1 in accordance with one embodiment.
Figure 3:
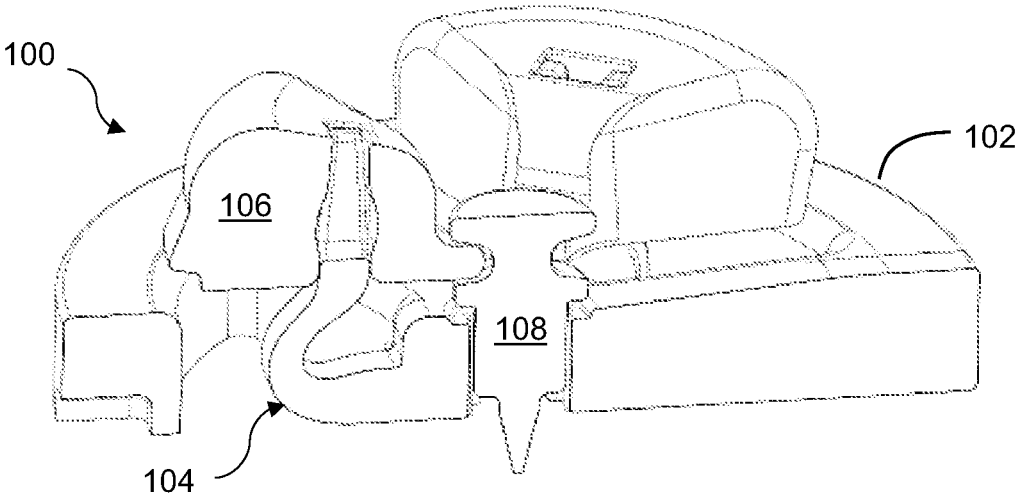
FIG. 3 illustrates a perspective view of the cross-sectional view of FIG. 2 in accordance with one embodiment.

The fuze assembly 100 may include a baseplate 102, one or more flexural portions 104, a weighted body 106 operably attached to each flexural portion 104, and a firing pin 108. FIG. 2 illustrates a cross-sectional view of the fuze assembly 100 of FIG. 1 taken along line 110 in accordance with one embodiment. FIG. 3 illustrates a perspective view of the cross-sectional view of FIG. 2 in accordance with one embodiment.

The baseplate 102 may support a plurality of components of the fuze assembly 100 and may be positioned towards the front of a projectile (not shown in FIGS. 1-3). The baseplate 102 may be configured with a bore 112 to receive and guide the firing pin 108 towards a detonator. The baseplate 102 may be manufactured from any suitable material as well as through additive-manufacturing (e.g., 3D-printing processes). One of ordinary skill in the art will recognize that various readily-available polymers used in 3D-printing are well-suited for this application generally and for the flexural portions 104, in particular.

The shape of the bore 112 may vary as long as it can receive and guide the firing pin 108 to the detonator as required. For example, the firing pin 108 need not be cylindrical. In some embodiments, the bore 112 may contain ribbed features 114 or other types of features parallel or substantially parallel to the direction of travel of the firing pin 108. These features may help minimize surface contact area between the firing pin 108 and the bore 112. These features may allow for looser tolerances in the diameter of the bore 112, the firing pin 108, or both. These features may also eliminate the need for lubrication of the interactive surfaces of the bore 112 and the firing pin 108.

The flexural portion(s) 104 may be configured integrally with the baseplate 102 or configured as separate component (s). In some embodiments, there may be only one flexural portion 104 that circumvents the bore 112. In other embodiments, the fuze assembly 100 may include multiple flexural portions 104 about the bore 112. In such embodiments, the flexural portions 104 are typically oriented radially with respect to the bore 112. For example, there are three flexural portions 104 in the embodiment shown in FIGS. 1-3.

The flexural portions 104 may include a base portion 116, a flexible component 118, and an end component 120 to which a weighted body 106 may be rigidly attached. The flexible component 118 acts as a sprung pivot and allows the weighted body 106 to rotate and translate radially outward (i.e., under centrifugal force) and inward (i.e., on impact). As discussed previously, barrels of rifles or other types of firearms can impart a rotational movement on a projectile to improve its ballistics. In some embodiments, flexible component 118 further controls the position of weighted body 106 prior to firing, thereby controlling the position of firing pin 108, e.g., to prevent premature detonation or damage to the firing pin 108 or other components (not shown) with which it might otherwise interact. One of ordinary skill in the art will recognize that the flexural characteristics of flexible component 118 will vary based on material(s) and geometry and that the resulting range-of-movement may be more complex that that depicted in FIG. 2.

The weighted body 106 may be rigidly attached to the flexural portion 104 and, specifically, to the end component 120. In the embodiment of FIGS. 1-3, each flexural portion 104 is configured with a weighted body 106. As seen in FIGS. 1-3, the weighted bodies 106, or at least the centers of mass thereof, are offset from an axis of rotation of the projectile.

Although FIGS. 1-3 illustrate the baseplate 102, the flexural portions, 104 and the weighted bodies 106 as separate components, they may instead be configured as a single component. Similarly, the flexural portions 104 need not be integral to the baseplate 102 and may be one or more separate components that are removably attachable to the baseplate 102.

Each weighted body 106 may include one or more apertures for receiving the end component 120. In the embodiments of FIGS. 1-3, each flexural portion 104 and, specifically, each end component 120, may extend up and through an aperture of the weighted body 106. For example, a weighted body 106 may slide over the end component 120 and be secured into place thereon.

The weighted body 106 may be secured on the flexural portion 104 via any suitable coupling mechanism such as, but not limited to, a press fit, a spring-and-lock connection, a clamping mechanism, an adhesive, a threaded screw connection, or the like. The exact type of coupling may vary as long as the objectives of the various embodiments herein may be accomplished. One of ordinary skill in the art will recognize that functionally-equivalent coupling mechanisms can be chosen such that the coupling between weighted body 106 and flexural portion 104 may be permanent, semi-permanent, or allow weighted body 106 to be interchangeable with or without tools. One of ordinary skill in the art will also recognize the advantage of coupling mechanisms that minimize variance in and distribution of mass among the possibly several weighted bodies and their corresponding flexural portions.

The flexible portion 104, including but not limited to flexible component 118, permits and regulates rotation and radial translation of the weighted body 106. The position and orientation of weighted body 106, in turn, controls the axial position of firing pin 108. Thus, forces on the weighted body 106, such as centrifugal (radial) forces caused by the rotation of the projectile or axial forces caused by impact moves the axial position of the firing pin 108. Referring specifically to the left-most weighted body 106 of the embodiment depicted in FIG. 2, centrifugal force causes counter-clockwise rotation of weighted body 106 which, in turn, moves firing pin 108 axially upward and away from a detonator or other firing mechanism. Likewise, on impact, the momentum of the weighted body 106, possibly combined by forces exerted by ogive portion 514 and actuator ring 516 (shown in FIG. 5, discussed below) cause clockwise rotation of weighted body 106, which propels the firing pin 108 axially downward to interact with a detonator or other firing mechanism, thereby effectuating detonation of the projectile.

One of ordinary skill in the art will recognize that flexible portion 104 and flexible component 118, individually and severally, further control the position of firing pin 108 when the projectile is at rest and when the projectile may be subjected to other forces, e.g., during loading, handling, transportation, etc. Such control of the position of firing pin 108 may be exploited as one of the safety mechanisms of the projectile or to prevent damage to firing pin 108 or downstream components under the aforementioned conditions.

One of ordinary skill in the art will recognize that the upward axial movement of firing pin 108 may allow the firing pin 108 to interact with arming, firing, safety, control, or other portions of the projectile (not shown). For example, an arming system may require that firing pin 108 translates a prescribed axial distance upward (from the perspective of FIG. 2) as part of an arming sequence.

One of ordinary skill in the art will further recognize that the position of firing pin 108 is directly proportional to the orientation of weighted body 106. As such, interaction between weighted body 106 and arming, firing, safety, control, or other portions of the projectile (not shown) may be functionally-equivalent to interaction between the same portions and the firing pin 108. For example, contact between surfaces 122 and 124 at the maximum extent of the counter-clockwise rotation of weighted body 106 may be detected as part of an arming sequence.

The baseplate 102 may also include an edge 122 to receive and prevent over-rotation of the weighted body 106. For example, the weighted body(ies) 106 may include a groove 124 that is shaped to engage the edge 122. This prevents excess outward deflection of the weighted bodies 106 and ensures they remain in contact with the firing pin 108. This further prevents inelastic deformation or other damage to flexural portion 104 or other components. Additionally, this ensures that the firing pin remains located within and in substantial axial alignment with bore 112.

Figure 4:
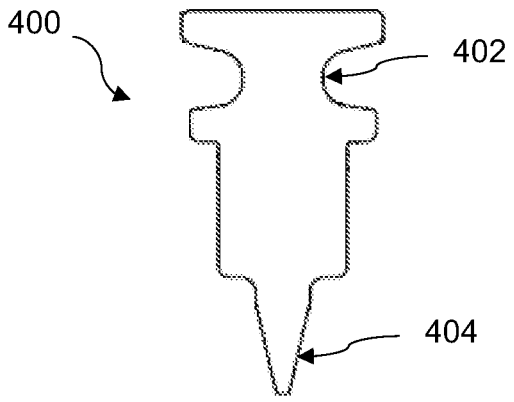
FIG. 4 illustrates a firing pin for a fuze assembly in accordance with one embodiment.

FIG. 4 illustrates a firing pin 400 such as the firing pin 108 of FIGS. 1-3 in accordance with one embodiment. The firing pin 400 may include an annular groove 402 that is shaped to receive or otherwise locate one of the weighted bodies (not shown in FIG. 4). The firing pin 400 may further include a tip portion 404 that actuates the detonator of a projectile.

One of ordinary skill in the art will recognize that there are many other equivalent configurations of the interacting features of and coupling between the firing pin 108 and weighted body 106. One of ordinary skill in the art will also recognize that the geometry of the tip portion 404 may be dependent on the type of detonator used in the projectile, and that the firing pin 108 may have other features (not shown) to interact with other components or provide other functions. One of ordinary skill in art will also recognize that the firing pin 108 may trigger or activate downstream firing chain components that detonate the detonator, and that the material composition, size, geometry, and mass of the firing pin may be chosen to ensure reliable detonation of a specific type of detonator.

Referring back to FIGS. 1-3, the flexural portions 104 may bias the weighted bodies 106 in a neutral position before the projectile is fired. During projectile flight (i.e., as or after the projectile has been fired), the centrifugal force on a weighted body 106 that is caused by the rotation of the projectile is translated, at least in part, into a torque moment on the end component 120 of flexural portion 104. This torque movement causes the flexural component 118 to flex, which causes the weighted body 106 to rotate such that groove 124 moves closer to or even contacts the edge 122. This movement of the weighted bodies 106 moves the firing pin 108 axially forward (or move "up" in the depictions of FIGS. 2 and 3) or otherwise away from the detonator.

At impact, one or more weighted bodies 106 move inward due to a force imparted on the weighted body 106 from the impact. The momentum and kinetic energy of weighted body 106 carries it forward and, due to its center of mass and the design of flexural portion 104, causes the weighted body 106 to rotate inward due to the ceasing of the rotational movement, the spring-back of the flexural portion 104, or some combination thereof. This movement of the weighted body(ies) 106 drives the firing pin 108 toward the detonator.

Figure 5:
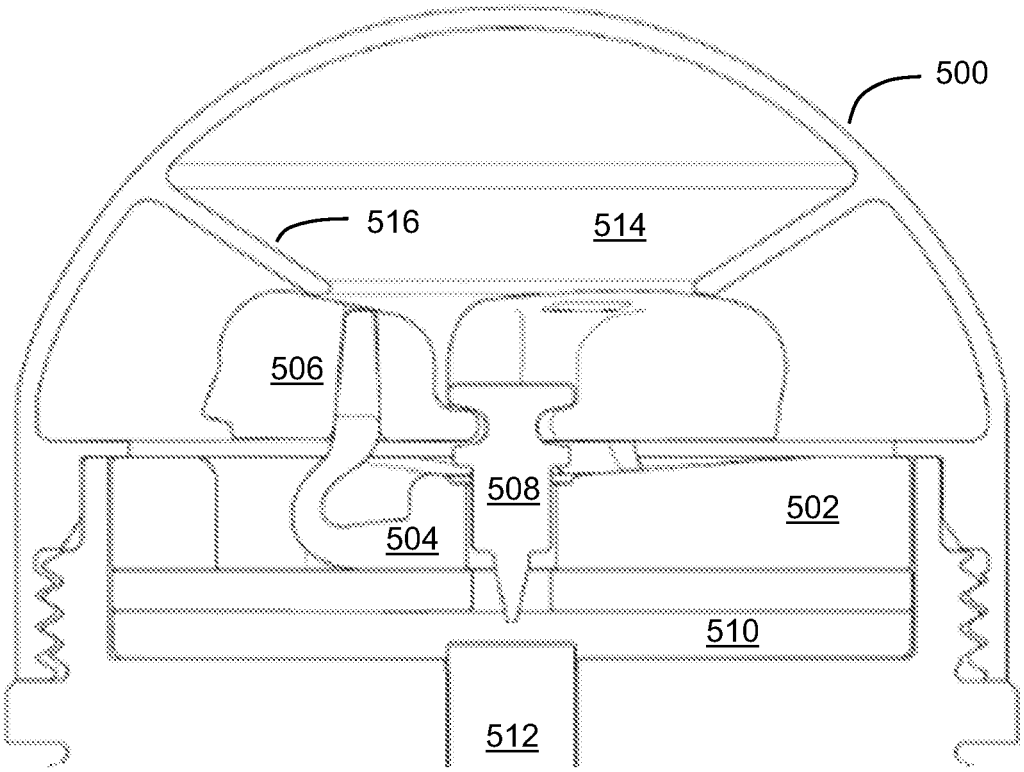
FIG. 5 illustrates a projectile including a fuze assembly in accordance with one embodiment.

FIG. 5 illustrates a fuze assembly such as the fuze assembly 100 of FIGS. 1-3 configured with a projectile 500 in accordance with one embodiment. The projectile 500 may be configured as one of a variety of munition types.

As in previous embodiments, the fuze assembly of FIG. 5 may include a baseplate 502, one or more flexural portions 504, a weighted body 506 operably attached to each flexural portion 504, and a firing pin 508. The projectile 500 of FIG. 5 may also include an arming mechanism 510 and a detonator 512 operably positioned with respect to the fuze assembly. One of ordinary skill in the art will recognize that the embodiment of FIG. 5 illustrates one of many possible configurations of a projectile 500.

Upon firing, the forward velocity and rotational movement of the projectile 500 causes the weighted bodies 506 to move radially outward from the center axis of the projectile, thereby translating the firing pin 508 axially away from the detonator 512. This axial movement prevents interaction between the firing pin 508 and the detonator 512 and, among other things, prevents premature detonation of the munition.

Upon impact, the resultant force drives at least one of the weighted bodies 506 inward toward the center of the projectile's center axis. This movement also drives the firing pin 508 axially toward the arming mechanism 510 and therefore to the detonator 512 to detonate the same.

One of ordinary skill in the art will recognize that the overall fore-and-aft axial movement of the firing pin 508 (i.e., fore during flight, aft upon impact) ensures that the firing pin 508 impacts the detonator 512 with sufficient force to detonate the detonator and that, with respect to the movement of firing pin 508, said force is substantially dependent on the total aft travel of the firing pin 508 due to impact. One of ordinary skill in the art will thus recognize that, in some embodiments, fore travel may be significantly smaller than aft travel, possibly to the point of being negligible.

FIG. 5 also illustrates an ogive portion 514 incorporating an actuator ring 516 in the interior of the projectile 500. Upon impact, at least a portion of the ring 516 may be displaced by deformation of the ogive portion 514 and forced against one or more weighted bodies 506. The force applied on the one or more weighted bodies 506 at least assists in driving the firing pin 508 towards the detonator 512.

In some embodiments, the actuator ring 516 may be integral to the ogive portion 514. In other embodiments, the actuator ring 516 is not integral to the ogive portion 514 and may be configured as a separate component.

As there may be multiple weighted bodies 506 about the firing pin 508, the projectile 500 isn't required to hit a target directly (i.e., perpendicular to its center axis or direction of travel) in order for the projectile 500 to detonate. Rather, an oblique impact may still detonate the projectile 500. For example, an oblique impact may still sufficiently displace one or more weighted bodies 506 to drive the firing pin 508 toward the detonator 512.

One of ordinary skill in the art will recognize that significant force may be transferred from the ogive to actuator ring to one or more weighted bodies over a wide range of angles-of-impact and that the extent of said force transfer and angles may depend on factors such as the material composition and geometry of the ogive portion 514 or the actuator ring 516. In some embodiments, the actuator ring 516 may comprise features that engage with features of a weighted body 506 as the ogive portion 514 deforms inward upon impact. For example, a segment or protrusion on the actuator ring 516 may positively-engage the through slot in the weighted body 106 that receives end component 120 or engage another slot, hole, ridge, groove, or other feature of weighted body 106.

In some embodiments, actuator ring 516 may be designed such that its correct interaction with weighted body 506 is independent of the angular orientation of actuator ring 516 with respect to baseplate 502, e.g., to simplify assembly processes. In some embodiments, ogive 514 and actuator ring 516, individually or severally, may prevent axial movement of a weighted body 506 with respect to flexural portion 504, for example, due to vibration or other forces imparted during handling, transportation, loading, etc.

The baseplates and flexural portions described herein may be modular in nature and configured to receive weighted bodies of a variety of shapes, sizes, and weights. In other words, a single baseplate may not only receive a first weighted portion of a first size and weight, but also be configured to, when not receiving the first weighted portion, receive a second weighted portion of a second size and weight. The selection of the weighted body(ies) may depend on a number of factors such as, but not limited to, the dimensions of the projectile or the spin rate of the projectile, which may in turn be dependent on the rotational velocity and acceleration of the projectile. Accordingly, the assemblies can be customized to meet the needs of a particular application.

In some embodiments, the baseplate may be configured to receive multiple variants of weighted portions. Accordingly, a munition can be adapted to accommodate a specific weapon or desired spin-rate by substituting one or more weighted portions. In some embodiments, weighted portions may be selected to tune or optimize the static or dynamic balance of the projectile, to set the overall mass of the projectile, or to otherwise alter terminal ballistic characteristics of the projectile.

Figure 6A:
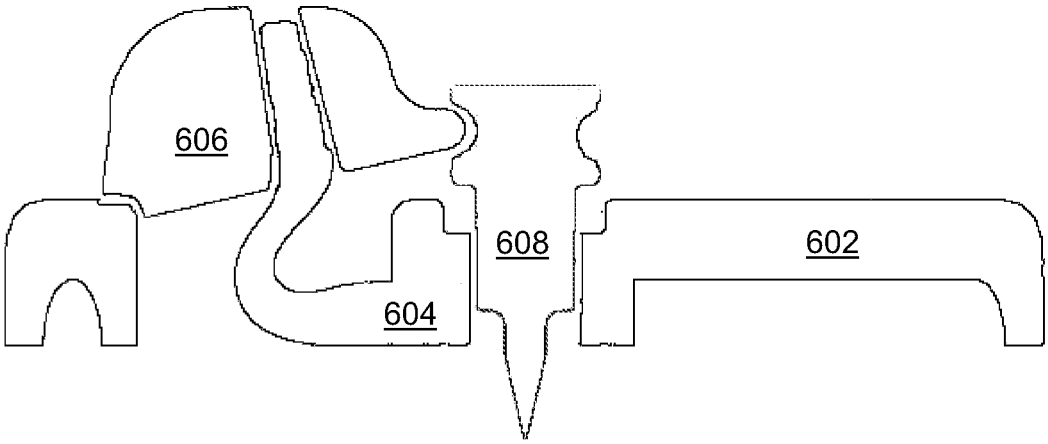
FIGS. 6A & 6B illustrate movements of various components of a fuze assembly in accordance with one embodiment.
Figure 6B:
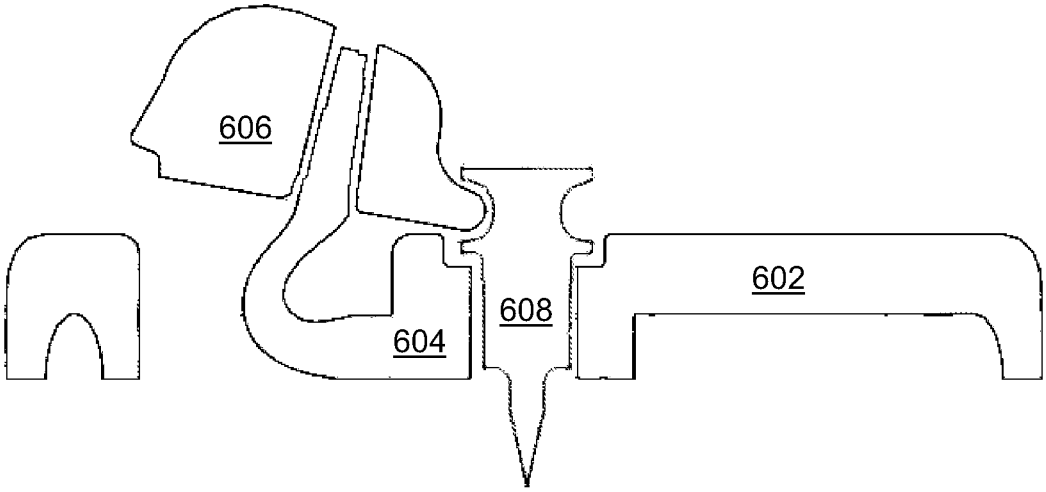

FIGS. 6A & 6B illustrate movements of a flexural portion, a weighted body, and a firing pin in accordance with one embodiment. Specifically, FIGS. 6A & 6B illustrate a baseplate 602, flexural portion 604, weighted body 606, and firing pin 608. Baseplate 602 may be similar to baseplates 102 and 502 discussed previously, flexural portion 604 may be similar to flexural portions 104 and 504 discussed previously, weighted body 606 may be similar to weighted bodies 106 and 506 discussed previously, and the firing pin 608 may be similar to firing pins 108 and 508 discussed previously.

As seen in FIG. 6A, the flexural portion 604 and the weighted body 606 have moved from a neutral position (as seen in FIGS. 2 and 3) and outwards away from the center of the fuze assembly. That is, FIG. 6A illustrates the flexural portion 604 and the weighted body 606 approximately at the full extent of their in-flight or safety position. As seen in FIG. 6A, this movement has caused the firing pin 608 to move towards the front of the projectile and away from detonator (not shown in FIG. 6A).

FIG. 6B illustrates that the fuze assembly at or at least approximately at impact. As seen in FIG. 6B, the flexural portion 604 and the weighted body 606 have moved inward toward the center of the fuze assembly. This movement has caused the firing pin 608 to move toward the rear of the projectile to contact the detonator (not shown in FIG. 6B) and detonate the same.

Figure 7:
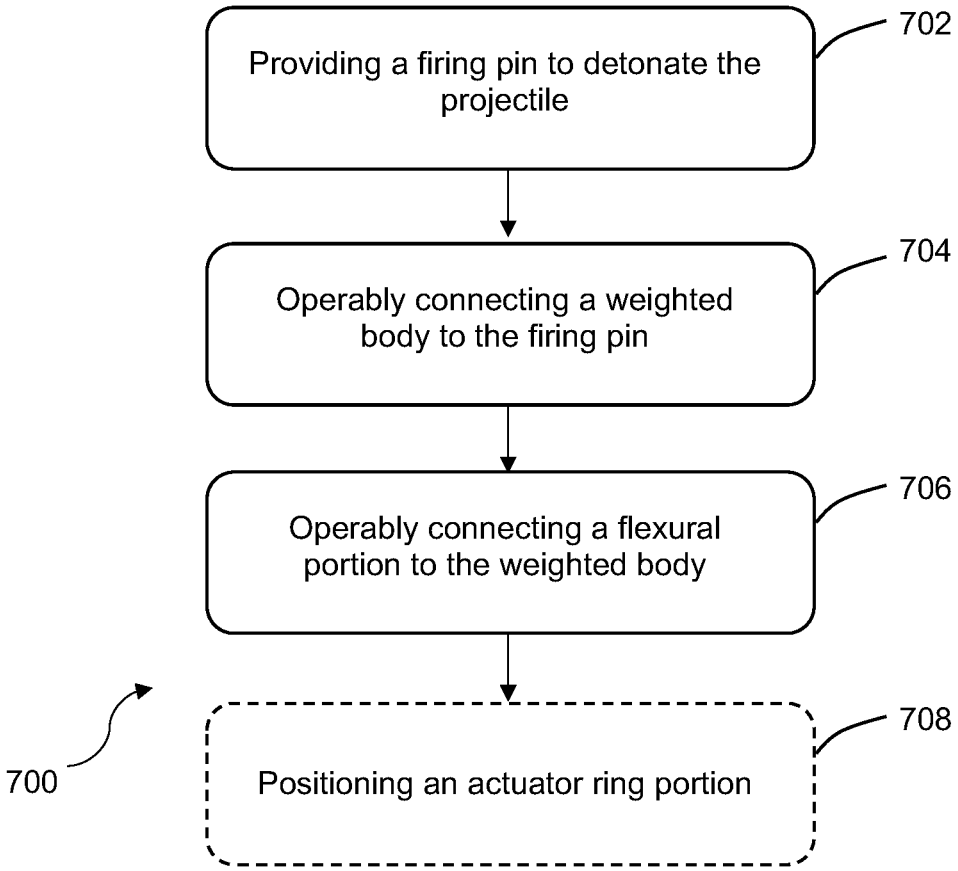
FIG. 7 depicts a flowchart of a method for assembling a projectile in accordance with one embodiment.

FIG. 7 depicts a flowchart of a method 700 for assembling a fuze for a projectile in accordance with one embodiment. Step 702 involves providing a firing pin to detonate the projectile. The firing pin may be similar to the firing pin 400 of FIG. 4, for example. Method 700 may further include configuring the firing pin with an annular groove, slot, or other type of feature to operably receive or locate a portion of a weighted body.

Step 704 involves operably connecting a weighted body to the firing pin. This step may involve connecting a plurality of weighed bodies to the firing pin. The weighted body(ies) may be similar to the weighted bodies 106 of FIGS. 1-3, for example.

The weighted body(ies) may include an arm portion to engage a groove or slotted portion of the firing pin. This engagement enables to weighted body to axially move the firing pin away and towards a detonator.

Step 706 involves operably connecting a flexural portion to the weighted body. The flexural portion may be similar to the flexural portion 104 of FIGS. 1-3 and may include a base and a flexible component. During flight, the flexural portion controls the position of the weighted body due to centrifugal force generated by the rotation of the projectile such that the firing pin is in a detonation prevention position. The flexural portion also controls the movement of the weighted body to drive the firing pin to a detonation position upon impact of the projectile.

The flexural portions may include a flexible component that rotates about a hinged portion as described in conjunction with FIGS. 1-3. The weighted bodies may include an aperture than can slide over or otherwise receive the flexible component to secure the weighted bodies in place.

Step 708 involves positioning an actuator ring portion to, upon impact of the projectile, apply a force to the weighted body to drive the firing pin to the detonation position. The actuator ring portion may be similar to the ring 516 of FIG. 5, for example. Even an oblique impact may cause a portion of the ring to drive one or more weighted bodies, and therefore the firing pin, to the detonator to detonate the same.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Embodiments of the present disclosure, for example, are described above with reference to block diagrams and/or operational illustrations of methods, systems, and computer program products according to embodiments of the present disclosure. The functions/acts noted in the blocks may occur out of the order as shown in any flowchart. For example, two blocks shown in succession may in fact be executed substantially concurrent or the blocks may sometimes be executed in the reverse order, depending upon the functionality/acts involved. Additionally, or alternatively, not all of the blocks shown in any flowchart need to be performed and/or executed. For example, if a given flowchart has five blocks containing functions/acts, it may be the case that only three of the five blocks are performed and/or executed. In this example, any of the three of the five blocks may be performed and/or executed.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of various implementations or techniques of the present disclosure. Also, a number of steps may be undertaken before, during, or after the above elements are considered.

Having been provided with the description and illustration of the present application, one skilled in the art may envision variations, modifications, and alternate embodiments falling within the general inventive concept discussed in this application that do not depart from the scope of the following claims.

What is claimed is:

1. A fuze assembly comprising:

a firing pin configured to detonate a projectile;

a plurality of weighted bodies in operable connectivity with the firing pin; and a plurality of flexural portions, wherein each of the plurality of flexural portions is operably connected with a weighted body of the plurality of weighted bodies and configured to:

control positioning of the weighted bodies due to centrifugal force generated by rotation of the projectile such that the firing pin is in a detonation prevention position, and control the movement of the weighted bodies to drive the firing pin to a detonation position upon impact of the projectile.

2. The fuze assembly of claim 1 further comprising a baseplate, wherein the two or more of the baseplate, a weighted body of the plurality of weighted bodies, and a flexural portion of the plurality of flexural portions are formed as a single component.

3. The fuze assembly of claim 1 further comprising a baseplate connected to the plurality of flexural portions and including a bore for directing the firing pin to the detonation position.

4. The fuze assembly of claim 3 wherein the baseplate is configured to:

receive a first weighted body of a first size and weight, enable an operator to remove the first weighted body, and receive a second weighted body of a second size and weight.

5. The fuze assembly of claim 3 wherein the bore is non-cylindrical and includes a ribbed component to minimize contact with the firing pin.

6. The fuze assembly of claim 1 wherein the firing pin includes an annular groove configured to receive the plurality of weighted bodies.

7. The fuze assembly of claim 1 wherein each of the plurality of weighted bodies include a deflection prevention feature to prevent excess deflection.

8. The fuze assembly of claim 1 wherein a center of mass of each of the plurality of weighted bodies is offset from an axis of rotation of the projectile.

9. The fuze assembly of claim 1 further comprising an actuator ring portion positioned to, upon impact of the projectile, apply a force to at least one of the weighted bodies to drive the firing pin to the detonation position.

10. The fuze assembly of claim 1 wherein each weighted body of the plurality of weighted bodies is operably connected to a single flexural portion.

11. The fuze assembly of claim 1 wherein the plurality of flexural portions are configured to control positioning of the weighted bodies such that the firing pin is in the detonation prevention position while the projectile is at rest or prior to the projectile being fired.

12. A method for assembling a fuze for a projectile, the method comprising:

providing a firing pin to detonate the projectile;

operably connecting a plurality of weighted bodies to the firing pin; and operably connecting a plurality of flexural portions to the plurality of weighted bodies to:

control the position of each of the plurality of weighted bodies due to centrifugal force generated by rotation of the projectile such that the firing pin is in a detonation prevention position, and control the movement of at least one of the plurality of weighted bodies to drive the firing pin to a detonation position upon impact of the projectile.

13. The method of claim 12 further comprising providing a baseplate, wherein two or more of the baseplate, a weighted body of the plurality of weighted bodies, and a flexural portion of the plurality of flexural portions are formed as a single component.

14. The method of claim 12 further comprising connecting a baseplate to the plurality of flexural portions, wherein the baseplate includes a bore for directing the firing pin to the detonation position.

15. The method of claim 14 wherein the baseplate is configured to:

receive a first weighted body of a first size and weight, enable an operator to remove the first weighted body, and receive a second weighted body of a second size and weight.

16. The method of claim 14 wherein the bore is non-cylindrical and includes a ribbed component to minimize contact with the firing pin.

17. The method of claim 12 further comprising providing the firing pin with an annular groove to receive the plurality of weighted bodies.

18. The method of claim 12 further comprising configuring each of the plurality of weighted bodies with a deflection prevention feature to prevent excess deflection.

19. The method of claim 12 wherein a center of mass of each of the plurality of weighted bodies is offset from an axis of rotation of the projectile.

20. The method of claim 12 further comprising positioning an actuator ring portion to, upon impact of the projectile, apply a force to at least one of the weighted bodies the weighted body to drive the firing pin to the detonation position.

21. The method of claim 12 wherein each weighted body of the plurality of weighted bodies is operably connected to a single flexural portion.

22. The method of claim 12 wherein the plurality of flexural portions are configured to control positioning of the weighted bodies such that the firing pin is in the detonation prevention position while the projectile is at rest or prior to the projectile being fired.

* * * * *